US007614838B2

(12) United States Patent
Geldmeier et al.

(10) Patent No.: US 7,614,838 B2
(45) Date of Patent: Nov. 10, 2009

(54) METHOD AND DEVICE FOR PRODUCING CASES WITH ROUNDED CORNERS

(75) Inventors: Günter Geldmeier, Stemwede-Oppendorf (DE); Frank Tautz, Rahden (DE); Gerhard Lintelmann, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 687 days.

(21) Appl. No.: 11/370,402

(22) Filed: Mar. 8, 2006

(65) Prior Publication Data

US 2006/0210378 A1 Sep. 21, 2006

(30) Foreign Application Priority Data

Mar. 17, 2005 (DE) ..... 10 2005 012 266
Jul. 29, 2005 (DE) ..... 10 2005 035 618

(51) Int. Cl.
*B42C 11/00* (2006.01)

(52) U.S. Cl. ..... 412/5; 412/17; 412/9

(58) Field of Classification Search ..... 412/1–6, 412/17–19, 21, 22, 902, 9; 270/52.01
See application file for complete search history.

(56) References Cited

U.S. PATENT DOCUMENTS 1,285,593 A * 11/1918 Baumann et al. ..... 412/3
1,336,944 A * 4/1920 Thomas ..... 412/17
1,898,123 A * 2/1933 Glass ..... 156/480
1,950,550 A * 3/1934 Glass ..... 156/479
2,668,575 A * 2/1954 Stringer ..... 156/446
3,128,484 A * 4/1964 Rogers et al. ..... 412/18
3,277,505 A * 10/1966 Peterson et al. ..... 412/17
4,889,461 A * 12/1989 Kampen et al. ..... 412/19
6,379,094 B1 * 4/2002 Porat ..... 412/9

FOREIGN PATENT DOCUMENTS

DE 14 11 693 C 1/1969
DE 41 29 241 A1 3/1993

* cited by examiner

*Primary Examiner*—Dana Ross
*Assistant Examiner*—Jamila Williams
(74) *Attorney, Agent, or Firm*—Alix, Yale & Ristas, LLP

(57) ABSTRACT

The invention pertains to a method and apparatus for producing cases with rounded corners. According to this method, the corner edge (10) that protrudes in the region of a rounded corner (9) is initially uprighted and turned over and subsequently pressed on the cover boards (7*a, b, c*) together with the turning-over and pressing-on of the lateral edge (11*a*) of an adjacent lateral border, in the same station (1). The apparatus comprises at least one rounded corner tool (3) that is arranged in the same station (1) in the which the lateral edges (11*a, b*) of opposed lateral borders that lie parallel to one another are uprighted, turned over, and pressed on the cover. The rounded corner tool (3) can be moved (b) toward the center of the case and out of the effective range of the lateral turn-in device (24) immediately before the turning-over and pressing-on movement (c, d) of the lateral turn-in device (24).

12 Claims, 3 Drawing Sheets

METHOD AND DEVICE FOR PRODUCING CASES WITH ROUNDED CORNERS

BACKGROUND OF THE INVENTION

The present invention pertains to a method and a device for producing cases with rounded corners in a book case machine.

Cases with rounded corners have no sharp-edged corners and exhibit an improved resistance to wear. They are used, e.g., for photo albums, diaries, writing cases and children's books. The cover boards of such cases have rounded corners, over which the cloth cover that is punched out in a star-shaped fashion on the corners is stretched and then pressed on. The specific star shape that is responsible for the production of clean turn-ins on the corners depends on the radius of the subsequent rounding, the cloth material and the thickness of the case. Neither excessive material accumulations nor visible gaps can be created.

DE 41 29 241 A1 discloses a method and a device for turning and gluing cloths over the borders of the cover board in the corner regions. The overhangs of the cloth are punched out in a tongue-shaped fashion in the region of the rounded corners and initially uprighted as well as pressed on the end faces of the lateral borders. These overhangs are then turned over and ultimately pressed on the up side of the cover board. For this purpose, the turn-in tool for rounded corners is provided with a guide surface that is adapted to the contour of the rounded corners, wherein a straight edge is provided above the guide surface which positions the overhanging strips upright in an aligned fashion during the upward movement of the tool. During this turning-over, the moving direction extends linearly from the lateral borders toward the center of the case, namely at an angle of 45° relative to the longitudinal side and the broadside of the case. In DE 41 29 241 A1, the corners are turned in during a separate production step after the lateral turn-in and the turn-in at the head/foot.

In the book case machine BDM 20 R of the firm Hörauf, a turn-in device of this type for rounded corners is arranged in an additional processing station situated upstream of the lateral turn-in station and the station for the turn-in at the head/foot, wherein a calibrating station is arranged downstream of the three turn-in stations in order to subsequently shape the rounded corners. The constructive expenditure for the two additional stations and for the expanded transport system that serves for the cyclic transport into the successively arranged processing stations is quite significant. In addition, the required floor space for the machine is increased.

SUMMARY OF THE INVENTION

The present invention is based on the objective of improving a method and a device for producing cases with rounded corners, such that high-quality rounded corners can be produced in a cost-efficient fashion. It should be possible to implement the method by retrofitting existing book case machines with the device. The device should have a simple constructive design and make it possible to turn in the rounded corners in a reliable and flawless fashion.

The inventive concept is based on pressing on the turned-over corner edge together with the lateral edge of an adjacent lateral border such that, contrary to conventional methods and devices, an additional pressing stroke of the rounded corner tool is not required. The pressure exerted when pressing on the lateral edge also is significantly higher than that of the rounded corner tool that is only able to exert a comparatively low pressing force due to its filigree design. The invention makes it possible to produce high-quality rounded corners.

The steps for uprighting, turning over and pressing on the respective edges are carried out in one of the two turn-in stations for the lateral edges, wherein the uprighting of the corner edge and of the corresponding lateral edge already takes place during the transport of the assembled case into the station. The corner edge is turned over immediately before the respective lateral edge is turned over and pressed on.

A separate turn-in station for rounded corners with a plurality of control movements and a transport system for delivering and transporting away the cases is no longer required. The device has a simple constructive design and allows a cost-efficient production of rounded corners. The turn-in station of an existing book case machine that was not designed for the production of cases with rounded corners can be retrofitted with the rounded corner tool such that the method can also be implemented on these machines.

In a first embodiment of the method, the turn-over movement of the uprighted corner edge toward the center of the case takes place parallel to the respective lateral border. Subsequently, the rounded corner tool is moved from this lateral border toward the center of the case. A few millimeters of the turn-over stroke carried out parallel to the lateral border already suffice for turning over the strips such that the required production steps can be carried out in rapid succession, because the movement of the rounded corner tool away from the lateral border can take place simultaneously with the inward movement of the turn-in tool. This rapid succession makes it possible to achieve high cycle rates.

In a second embodiment of the method, the corner edge is turned over by a tool that essentially moves toward the center of the case diagonal to the adjacent lateral borders. In this case, the tool moves away from the lateral border with a component such that the corresponding lateral edge is turned over immediately thereafter. The turning-over of the corner edge and of the lateral edge practically takes place simultaneously such that high cycle rates can be achieved.

If the corner edge is punched out several times, it is advantageous to upright and align the individual tabs successively in a controlled fashion such that they do not impair one another and no material accumulations or visible gaps are created when the tabs are subsequently turned over. The central tab is preferably uprighted first. According to one advantageous production sequence, the corner edge and one adjacent lateral edge are collectively pressed on first and the other adjacent lateral edge is subsequently turned over and pressed on in a downstream station. The turned-over tabs of the corner edges ultimately lie underneath the turned-over lateral edges in this case. According to one preferred embodiment of the method, the corner edge is turned over immediately before turning over the lateral edge at the head/foot and pressed on the case together with this lateral edge.

In a device for implementing the method, the at least one rounded corner tool is arranged in the first station for turning over and pressing on the lateral edges of first lateral borders that lie parallel to one another. The rounded corner tool can be moved toward the center of the case immediately before the turning-over and pressing-on movement of the turn-in means in order to turn over the uprighted corner edge, wherein the rounded corner tool can be moved out of the effective range of the turn-in means in order to press on the turned-over corner edge by means of the pressing-on movement of the turn-in means.

In one advantageous embodiment of the device, the uprighting edge of the rounded corner tool has sections that are offset relative to one another in height and respectively assigned to one punched-out tab such that the individual tabs of a corner edge that is punched out several times are uprighted and aligned successively in a controlled fashion when the assembled case is transported into the first station. A central section of the uprighting edge preferably protrudes relative to the adjacent sections such that the central tab is uprighted first.

Rounded corner tools are advantageously provided for all four corners of the case in the first station, wherein two rounded corner tools are respectively assigned to the turn-in means for the two lateral edges to be turned in within this station. This means that rounded corners can be simultaneously produced on all four corners.

The rounded corner tool is preferably accommodated on a boom of the turn-in means. Such a boom is typically provided in conventional book case machines for the corner creaser used in the production of cases with pointed corners. In other words, the corner creaser is replaced with the rounded corner tool such that the machine can be quickly changed over from one production mode to another production mode. The boom is adjustable with respect to the case format. This means that the adjusting device can also be used for the rounded corner tool.

In another advantageous embodiment, the guide surface is bordered by a turn-over edge that lies above the case after the case is transport into the station, wherein the rounded corner tool can be moved toward the center of the case parallel to the major surface of the case.

In a first operating mode of the embodiment of the invention, the turn-over movement of the rounded corner tool is directed toward the center of the case and parallel to the lateral border, the lateral edge of which is turned over and pressed on immediately thereafter, wherein the rounded corner tool can be subsequently moved out of the effective range of the turn-in means. During this process, the rounded corner tool preferably carries out a slight turn-over stroke of one to five millimeters. In one advantageous variation of this first embodiment, the rounded corner tool can be moved away from the turn-in means in a driven fashion. The rounded corner tool is moved toward the center of the case synchronous with the inward movement of the turn-in bar and therefore always lies outside the effective range of the turn-in means. Additional driving means for realizing this movement out of the functional range are not required. Since the turn-in bar directly follows the rounded corner tool, the turned-over strips are constantly held down and therefore cannot separate. In another advantageous variation, the rounded corner tool is provided with a pressing element that adjoins and presses on at least part of the rounded corner after the parallel turn-over movement toward the center of the case is completed.

In a second embodiment of the device, the rounded corner tool is accommodated on the boom of the turn-in means in a pivoted fashion such that it can be pivoted toward the center of the case essentially diagonal to the adjacent lateral borders of the respective corner together with the turn-over movement of the turn-in means.

According to one advantageous variation of the device, the turn-in means comprise a turn-in bar that initially turns over the lateral edge with a movement that is directed parallel to the major surface of the case and subsequently firmly presses this lateral edge and the turned-over corner edge on the case with a vertical movement. In contrast to other turn-in means such as, for example, a turn-in brush, the turn-in bar makes it possible to exert high pressing forces such that the tabs and the lateral edges can be pressed on in a nearly flush fashion in the corner regions.

It can thus be understood that in a general aspect, the improvement comprises that at a single work station, the edges of the cloth in a region of a rounded corner are turned over and subsequently pressed on the exposed side of the cover in a sequence that is respectively simultaneous with the sequence of turning over and pressing of the cloth edge along an associated lateral border. Although the start or completion of the turning over of the corner edge and the start or completion of the turning over of the lateral edge may not be simultaneous, at the time the lateral edge is pressed, both the corner edge and the lateral edge are simultaneously in a turned down condition, and both are pressed simultaneously. Preferably, all the corner edges and a pair of opposed lateral edges are uprighted substantially simultaneously while the case is being positioned onto a work table, although the uprighting of individual tabs in the corners can be sequential during such positioning.

It should be understodd that in the step of turning over the edges, one edge is turned over while the other edge is turned over. In this context, "while" denotes a duration or period of time, i.e., the corner edges and lateral edges are both in a state or condition of being turned over for some common time period or duration. This does not require that the acts of turning over (physical change of position or orientation) must occur with any overlap in time.

BRIEF DESCRIPTION OF THE DRAWINGS

Exemplary embodiments of the invention are described in greater detail below with reference to the accompanying drawing, in which.

DESCRIPTION OF THE PREFERRED EMBODIMENTS

Figure 1:
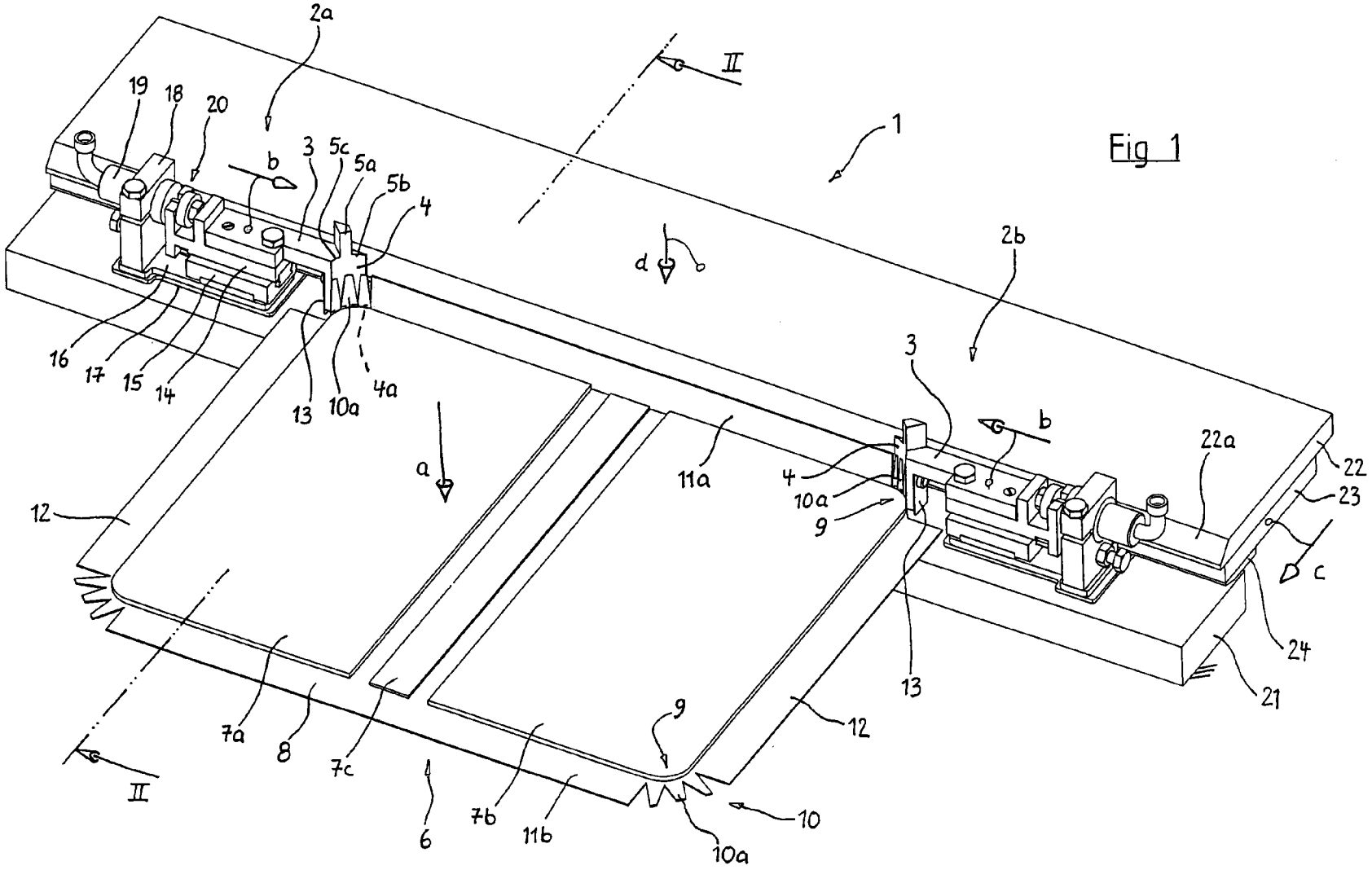
FIG. 1 is a perspective representation of a device for the turn-in at the head of a (head) lateral edge of an assembled case, with two rounded corner tools according to a first embodiment for the two rounded corners of the corresponding lateral edge.

FIG. 1 shows a device 1 for the turn-in at the head, to which are assigned two rounded corner turn-in devices 2*a, b*. The device 1 for the turn-in at the head and a not-shown, diametrically opposed device for the turn-in at the foot collectively form a head/foot turn-in station for a book case machine, in which cases 6 are produced that respectively consist of two cover boards 7*a, b*, a board center strip 7*c* as well as a cloth material 8 that is glued on the outside (downside in the illustrated embodiment) of the board sections 7*a, b, c*.

The board sections 7*a, b, c* are placed onto the oversized cloth material 8 that is coated with glue over its entire surface and punched out in a star-shaped fashion in the corner regions, at an joining station arranged upstream of the head/foot turn-in station. In the head/foot turn-in station, the lateral edges 11*a, b* protruding over the borders at the head and at the foot of the case 6 are turned in, and the lateral edges 12 of the lateral borders extending transverse to the borders at the head/foot are turned in within the following lateral turn-in station. The cases are ultimately rubbed down by the pressing rollers of a pressing station and transported out of the book case machine in stacks by means of a delivery device.

The turning-in process consists of uprighting the protruding lateral edges 11*a, b*, 12, turning over these edges onto the (in the illustrated embodiment) up side of the case 7*a, b*, as well as pressing on and therefore pressing together the lateral edges with the case 7*a, b*. During the turn-in at the head/foot, the lateral edges 11*a, b* are uprighted when the assembled case 6 is transported into the head/foot turn-in station. During this process, the case 6 is held against boom supports 26 by means of suction elements 25, as well as moved along an uprighting edge 22*a* of a lifting plate 22 with the border at the head or foot in the form of a vertical stroke and pressed on the table 21 by the boom supports 26. The turning-over is then carried out with a turn-in device 24 that is connected to a sliding plate 23 and moved toward the center of the case with a small clearance above covers 7*a, b*. Subsequently, the turn-in device 24 presses on the turned-over lateral edge 11*a* simultaneously with the lowering of the lifting plate 22, in which the sliding plate 23 is guided in a horizontally displaceable fashion.

The inventive integration of a total of four rounded corner turn-in devices 2*a, b* into the head/foot turn-in station makes it possible to turn in the corner edges 10 of rounded corners 9 of a case 6 simultaneously with the lateral edges 11*a, b* of the border at the head/foot such that another separate station is not required for this purpose.

The rounded corner turn-in device 2*a, b* comprises a rounded corner tool 3 that is accommodated by a slide 14 and guided parallel to the border at the head in a linear guide 15. The linear guide 15 is mounted on a support 16 that also carries a block 18, in which a compact pneumatic cylinder 19 for driving the rounded corner tool 3 via a driver 20 is accommodated. The pneumatic cylinder 19 has a simple pneumatic control and is provided with a return spring for holding the rounded corner tool 3 in its starting position that is defined in that the rounded corner 9 is transported along a concavely shaped guide surface 4 during the transport of the assembled case 6 into the head/foot turn-in station via boom support 26.

On the upper end that lies opposite of the case 6 being transported into the station, the guide surface 4 is bordered by an uprighting edge consisting of three uprighting edges 5*a, b, c* that are offset relative to one another in height. The central uprighting edge 5*a* protrudes relative to the two adjacent uprighting edges 5*b, c* and is assigned to a central tab 10*a* of the three tabs of corner edge 10 that are punched out in a star-shaped fashion. During the transport of the case 6 into the station, the central tab 10*a* consequently is uprighted before the two adjacent tabs. During the continued transport of the case 6, the tabs that were uprighted in a controlled fashion are pressed on the rounded corner 9 of the case 7*a* and *b* by the guide surface 4.

As soon as the case 6 lies on the table 21 while being pressed down by the boom supports 26, the entire rounded corner tool 3 is moved toward the center of the case parallel to the border at the head of the case 6 by a slight stroke of one to five millimeters. A turn-over edge 4*a* that borders the guide surface on the lower end sweeps over the cover boards 7*a* and *b* with a clearance therefrom (e.g., of about two tab thicknesses) and turns over the uprighted tabs. Preferably, a flat pressure plate 13, such as a spring steel strip, is arranged on the rear side of the rounded corner tool 3 to contact and press a portion of the cloth against a portion of the face of the edge (small face) forming the border of the rounded corner.

Immediately after the rounded corner tool 3 carries out the turn-over movement, the sliding plate 23 is moved toward the center of the case together with the turn-in device 24. A driver causes the rounded corner tool 3 to also synchronously move away from the border at the head, toward the center of the case. For this purpose, the rounded corner turn-in device 2*a* and *b* is mounted on a boom 17 that is guided horizontally and transverse to the border at the head in a linear guide 29 by means of a block 27, wherein the block 27, in turn, is provided with a slideway 27*a*, in which an angle 28 is guided that originates at the sliding plate 23. Due to this mechanical connection these measures, both rounded corner turn-in devices 2*a, b* are always spaced apart from the turn-in device 24 by the same distance. As the corner tool 3 moves away from the cover border at the head toward the cover border at the foot, the pressure plate 13 glides on and presses the face of the edge of the cover board.

The lateral edge 11*a* is turned over by the turn-over movement of the turn-in device 24, wherein the lateral edge partially covers the previously turned-over corner edges 10. The turned-over corner edges 10 and the lateral edge 11*a* are subsequently pressed together with the cover 7*a, b* in a nearly flush fashion by means of the vertical pressing movement of the turn-in device 24.

Figure 2:
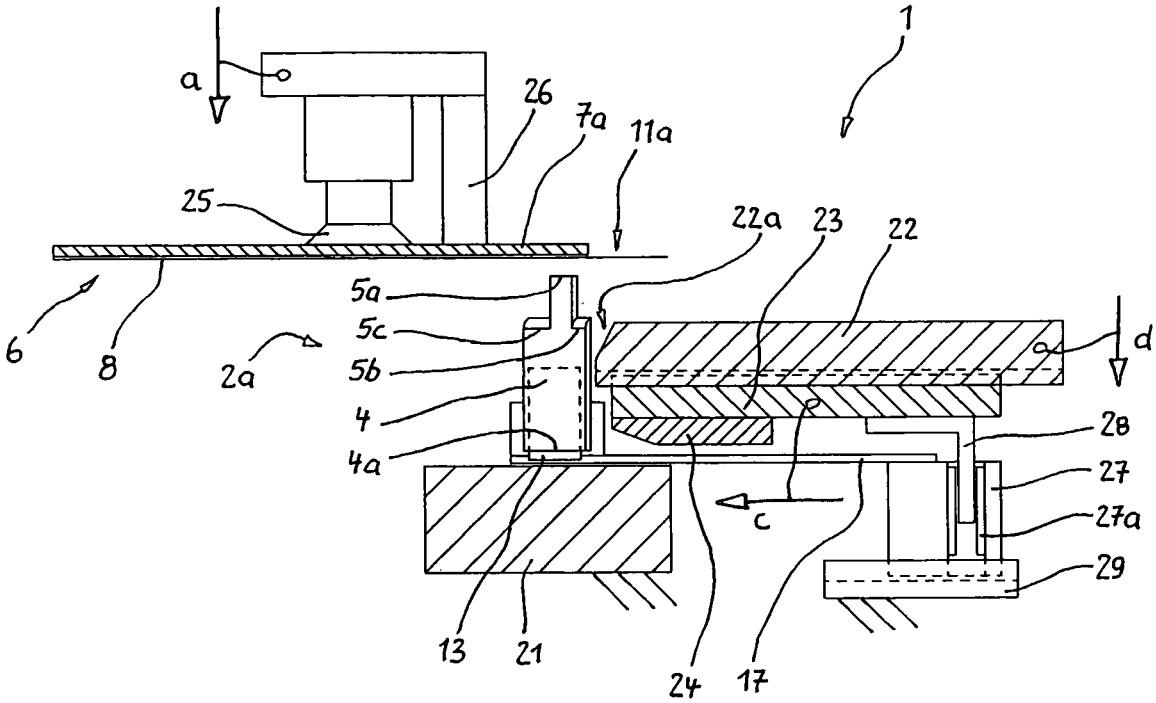
FIG. 2 is a section through the device for the turn-in at the head along the line II-II in FIG. 1, wherein the assembled case is situated above the device for the turn-in at the head.

In both FIGS. 1 and 2, directional arrows identified by the reference symbols a through d are shown on the moving components of the device 1 for the turn-in at the head, wherein said arrows elucidate the sequence of the individual functional steps of the first embodiment:

a vertical transport of the case 6 into the device 1 for the turn-in at the head and therefore uprighting the corner edges 10 and the lateral edge 11*a;* b horizontal turn-over movement of the rounded corner tool 3 parallel to the border at the head, toward the cover center strip 7*c* in order to turn over all the tabs of the corner edge 10 (with optional pressing on at the edge face by pressure plate 13);

c horizontal turn-over movement of the turn-in device 24 transverse to the turn-over movement of the rounded corner tool 3, toward the foot of the case, wherein the rounded corner tool 3 is synchronously moved away from the border at the head toward the foot of the case, by a driver, and d vertical pressing movement of the turn-in device 24 in order to press on the turned-over lateral edge 11*a* of the border at the head together with the corner edges 10 of the corresponding rounded edges of the border at the head.

The boom 17 consists of a conventional boom as it is provided in known book case machines for accommodating a corner creaser used in the production of cases with pointed corners. The book case machine can be quickly changed over from one production mode to another production mode by simply exchanging the tools. In this respect, it is advantageous that the movement of this boom can be used for both production modes, and that the adjustment of the boom can be utilized analogously with respect to the case format. This means that, with the exception of a pneumatic connection for the pneumatic cylinder 19 and a corresponding control code in the sequence control, no excessively high constructive expenditures are required for the integration of the rounded corner turn-in device 2*a, b*.

Figure 3:
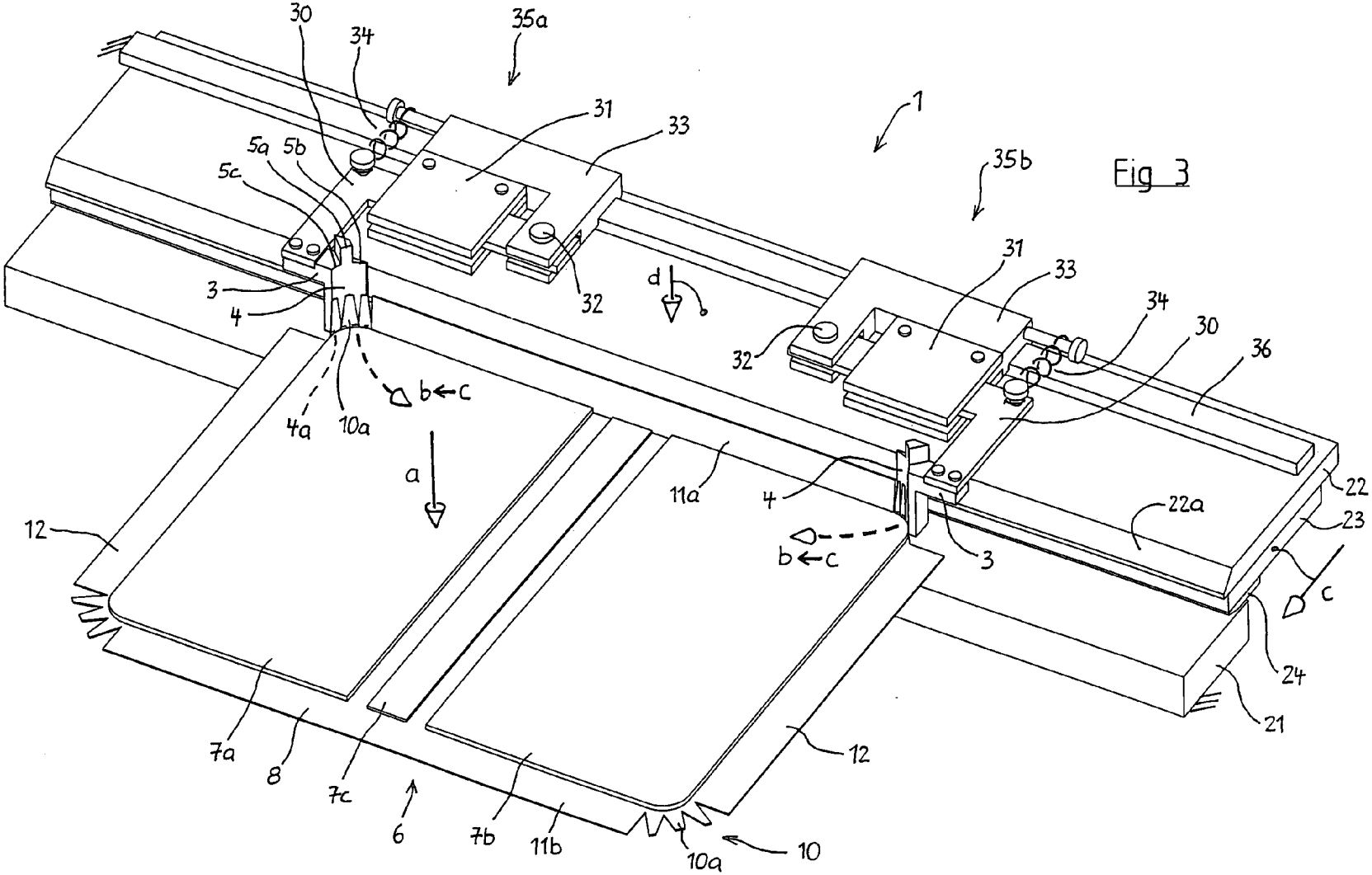
FIG. 3 is a perspective representation of a device for the turn-in at the head, with two rounded corner tools according to a second embodiment.

FIG. 3 shows a second embodiment of the invention in the form of rounded corner turn-in devices 35*a, b*. The rounded corner tool 3 is received on a pivoted arm 30 that is accommodated above the lifting plate 22 on a holder 33 by means of a rotary joint 32 and guided between guide plates 31. The rounded corner tool 3 is held in its starting position by a tension spring 34 engaging on the pivoted arm 30. The supply of the cases 6, as well as the uprighting of the corner edge 10 on the uprighting edges 5*a, b, c*, takes place analogous to the first embodiment.

However, the second embodiment differs from the first embodiment in the turn-over movement of the rounded corner tool 3 and its actuation. A direct actuation of the rounded corner tool 3 is not provided in this case. The rounded corner tool 3 is pivoted away from the border, toward the center of the case, while the turn-in device 24 is moved for turning over, whereby the rounded corner tool 3 is pushed in front of the turn-in device 24 against the force of the spring. During this process, the rounded corner tool 3 carries out a turn-over movement of the tabs of the corner edge toward the center of the case that is essentially directed diagonally with reference to both adjacent lateral edges 11*a* and 12.

In this embodiment, the lateral edge 11*a* is turned over almost simultaneously with the corner edge 10. This is the reason why the functional step of turning over the corner edge 11 by means of the rounded corner tool 3 is illustrated by a directional arrow drawn with broken lines in FIG. 3, wherein the designation b←c is also provided. The successive functional steps of the second embodiment are carried out as follows:

a vertical transport of the case 6 into the device 1 for the turn-in at the head and therefore uprighting the corner edges 10 and the lateral edge 11*a;* b horizontal turn-over movement of the turn-in device 24 toward the center of the case, wherein both rounded corner tools 3 are pivoted away from the border at the head in the form of a turn-over movement toward the center of the case (diagonally with reference to the lateral edges 11*a* and 12) in order to turn over the corner edges immediately before the lateral edge 11*a* is turned over;

c vertical pressing movement of the turn-in device 24 in order to press on the turned-in lateral edge 11*a* of the border at the head together with the corner edges 10 of the correspondingly rounded corners of the border at the head.

The integration of the rounded corner turn-in device 35*a, b* according to the second embodiment does not require excessively high constructive expenditures. The holder 33 can be accommodated by simply providing a stationary rail 36 in the device 1 for the turn-in at the head. No additional driving means are required for the rounded corner turn-in device 35*a, b* such that the sequence control of the book case machine does not have to be modified.

The utilization of the method according to the invention is not restricted to the production of cases consisting of four parts. The device also makes it possible to produce game boards in the form of a case construction consisting of two or three parts, as well as complex cases with rounded corners that consist of six or more parts. The method and the device are not restricted to turning in corner edges 10 that are punched out in a star-shaped fashion. It would also be possible to process individual tabs. Tongue-shaped and/or undercut tabs can be turned in in addition to tapered tabs.

The invention claimed is:

1. A device in a book case machine to produce cases with rounded corners, in which at least one cover board having four corners formed at intersecting lateral borders is glued on one side to an oversized cloth material, forming intersecting lateral edges of the cloth and corner regions of cloth defined by a plurality of tabs, and the edges of the cloth material are subsequently turned over and pressed onto the other side of the cover board on a pressing table, comprising:

means for turning upright a first lateral edge of a case as the case is transported onto to the pressing table, turning over, and then pressing on said first lateral edge;

a pair of rounded corner tools for uprighting and turning over the corner edge at each of two rounded corners associated with said first lateral border, said tools each having a concavely shaped guide surface that is adapted to the rounded corner, and an uprighting edge for turning upright the corner edge of the case as the case is transported downwardly to the pressing table such that the rounded corner of the case moves along the guide surface, wherein the pair of rounded corner tools and associated means for turning upright a lateral edge of a case are arranged at the same table;

the device uprights the edges of the cloth at said corners and along the associated lateral border simultaneously, turns the edges over, and subsequently presses the edges on the upper side of the cover simultaneously;

when the case is on the table, each rounded corner tool is movable toward the center of the case in order to turn over the uprighted corner edge immediately before the turning-over and pressing-on movement of the means for turning upright a lateral edge of a case; and the rounded corner tools are movable out of the effective range of the means for turning upright a lateral edge of a case, whereby the lateral turn-in means can press on the turned-over corner edge.

2. The device according to claim 1, wherein the uprighting edge of each corner tool has sections that are offset in height and respectively assigned to one tab of the corner edge.

3. The device according to claim 2, wherein a central section of the uprighting edge protrudes relative to adjacent sections.

4. The device according to claim 1, wherein rounded corner tools are provided at the same pressing table for all four corners of the case, with one pair of rounded corner tools and one means for turning upright a lateral edge of a case assigned to each of two opposed lateral edges to be turned in at said pressing table.

5. The device according to claim 1, wherein the rounded corner tools are arranged on a boom operatively connected to said means for turning upright a lateral edge of a case.

6. The device according to claim 1, wherein the guide surface has a lower end bordered by a turn-over edge that is at an elevation above the cover boards after the case is transported onto the pressing table, and the rounded corner tool is movable toward the center of the case over said other side of the cover board.

7. The device according to claim 6, wherein the rounded corner tool is movable toward the center of the case parallel to the lateral border by a driver, the lateral edge of said lateral border is turned over and pressed on immediately by the means for turning upright a lateral edge of a case thereafter at said pressing table, and the rounded corner tool is moveable out of the effective range of the means for turning upright a lateral edge of a case.

8. The device according to claim 7, wherein the rounded corner tool is movable toward the center of the case over a turn over stroke (b) of one to five millimeters.

9. The device according to claim 7 wherein the rounded corner tool is moved out of the effective range of the means for turning upright a lateral edge of a case by a mechanical connection to the means for turning upright a lateral edge of a case.

10. The device according to claim 7, wherein the rounded corner tool comprises a pressing element that adjoins and presses on at least a portion of the end face of the rounded corner after the turn-over movement (b) toward the center of the case is completed.

11. The device according to claim 5, wherein the guide surface has a lower end bordered by a turn-over edge that is at an elevation above the cover boards after the case is transported onto the pressing table, and the rounded corner tool is movable toward the center of the case over said other side of the cover board; and the rounded corner tool is arranged on the boom of the means for turning upright a lateral edge of a case by a pivot connection, wherein the rounded corner tool can be pivoted toward the center of the case essentially diagonal to the adjacent lateral borders of the respective corner by the turn-over movement of the means for turning upright a lateral edge of a case.

12. Device according to claim 1, wherein the means for turning upright a lateral edge of a case comprise a turn-in bar that initially turns over the lateral edge by a movement (c) that is directed parallel to the upper surface of the case and subsequently firmly presses this lateral edge and the turned-over corner edge onto the cover board of the case.

* * * * *